United States Patent [19]

Emsperger et al.

[11] Patent Number: 4,493,186

[45] Date of Patent: Jan. 15, 1985

[54] STEAM POWER PLANT AND STEAM GENERATOR, ESPECIALLY SUITED FOR A STEAM POWER PLANT OF THIS TYPE

[75] Inventors: Werner Emsperger, Erlangen; Reiner Engelhardt, Effeltrich, both of Fed. Rep. of Germany

[73] Assignee: Kraftwerk Union Aktiengesellschaft, Mülheim, Fed. Rep. of Germany

[21] Appl. No.: 403,793

[22] Filed: Jul. 30, 1982

[30] Foreign Application Priority Data

Aug. 18, 1981 [DE] Fed. Rep. of Germany ..... 3132659

[51] Int. Cl.[3] ..... F02C 6/04

[52] U.S. Cl. ..... 60/39.182; 60/663; 122/1 R

[58] Field of Search ..... 60/39.182, 553, 662, 60/663; 122/1 R, 4 D

[56] References Cited

U.S. PATENT DOCUMENTS

| | | | |
|---|---|---|---|
| 2,818,049 | 12/1957 | Blaskowski | 60/39.182 |
| 2,869,520 | 1/1959 | Paulison | 122/479 |
| 3,137,134 | 6/1964 | Macheney | 60/39.182 |
| 3,863,606 | 2/1975 | Bryers et al. | 122/4 D |

FOREIGN PATENT DOCUMENTS

| | | |
|---|---|---|
| 504114 | 4/1939 | United Kingdom . |
| 755057 | 8/1956 | United Kingdom . |
| 861130 | 2/1961 | United Kingdom . |
| 955992 | 4/1964 | United Kingdom . |

*Primary Examiner*—Louis J. Casaregola

*Attorney, Agent, or Firm*—Herbert L. Lerner; Laurence A. Greenberg

[57] ABSTRACT

Steam power plant, including a steam turbine having a high pressure section with an exhaust steam outlet, a steam generator having a live steam side connected upstream of the high pressure section of the steam turbine, the steam generator having a combustion chamber and a convection space formed therein, an intermediate superheater heating surface having an outlet and having an inlet being connected to the exhaust steam outlet of the high pressure section of the steam turbine, a device for applying combustion air to the combustion chamber of the steam generator, and a device disposed at the outlet of the intermediate superheater heating surface for regulating steam temperature thereat, the regulating device including a nozzle terminating in the convection space of the steam generator between the combustion chamber and the intermediate superheater heating surface.

1 Claim, 2 Drawing Figures

STEAM POWER PLANT AND STEAM GENERATOR, ESPECIALLY SUITED FOR A STEAM POWER PLANT OF THIS TYPE

The invention relates to a steam power plant with a steam generator having a live steam side connected to the high pressure section of a steam turbine, a combustion chamber, a convection space in which an intermediate superheater heating surface is disposed, means for supplying combustion air, the intermediate superheater heating surface being connected to the exhaust steam outlet of the high pressure section of the steam turbine, and a device for regulating the steam temperature at the outlet of the intermediate superheater. The invention also relates to a steam generator which is especially suited for a steam power plant of this type.

Steam power plants of this type have been constructed in the past. The device they employ for regulating the steam temperature at the intermediate superheater outlet is formed of water jets at the inlet of the intermediate superheater heating surface, which inject water when the permissible steam temperature at the intermediate superheater outlet is exceeded.

The injection water is compressed in a pump when the permissible steam temperature at the intermediate superheater outlet is exceeded. This water evaporates in the tubes of the intermediate superheater heating surface, and mixes with the exhaust steam at that location, with the result that the steam temperature at the intermediate superheater outlet is lowered.

The water injected into the inlet of the intermediate superheater heating surface comes from the feedwater tank of the steam generator, and bypasses the high pressure section of the turbine. Therefore, the water does not work in this high pressure section. The result is a reduced efficiency level of the turbine.

It is accordingly an object of the invention to provide a steam power plant and a steam generator, especially suited for a steam power plant of this type, which overcomes the hereinafore-mentioned disadvantages of the heretofore-known devices of this general type, and to improve the efficiency of the steam power plant.

With the foregoing and other objects in view there is provided, in accordance with the invention, a steam power plant, comprising a steam turbine having a high pressure section with an exhaust steam outlet, a steam generator having a live steam side connected upstream of the high pressure section of the steam turbine, the steam generator having a combustion chamber and a convection space formed therein, an intermediate superheater heating surface having an outlet and having an inlet being connected to the exhaust steam outlet of the high pressure section of the steam turbine, means for supplying combustion air to the combustion chamber of the steam generator, and means disposed at the outlet of the intermediate superheater heating surface for regulating steam temperature thereat, the regulating means including a nozzle preferably for cooling gas or cooling air terminating in the convection space of the steam generator between the combustion chamber and the intermediate superheater heating surface.

With the aid of this cooling gas nozzle which ends in the convection space of the steam generator, it is possible to cool the exhaust gas in the convection space by the injection of a cooling gas, so that the intermediate superheater heating surface accepts less heat due to the reduced temperature gradient with respect fo the exhaust gas. Therefore, a much smaller quantity of water is necessary to be injected onto the intermediate superheater heating surface, if the injection of water is necessary at all, so that the high pressure section of the turbine generates more power.

In accordance with another feature of the invention, the steam generator has an exhaust gas side, and including an exhaust gas turbine connected downstream of the exhaust gas side of the steam generator, and a compressor being driven by the exhaust gas turbine and being connected to the nozzle. This accomplishes a further improvement of the total efficiency of the power plant, because due to the reduced heat transfer from the exhaust gas to the intermediate superheater heating surface, the exhaust gas has a much higher temperature at the inlet of the gas turbine.

In accordance with a further feature of the invention, the means for supplying combustion air includes a combustion air nozzle disposed at the combustion chamber, and the steam generator for a steam power plant of this type has a water side and high pressure heating surfaces having a live steam outlet, and the intermediate superheater heating surface is separated at the water side from the high pressure heating surfaces.

In accordance with an added feature of the invention, there is provided a barrier disposed between the intermediate and high pressure heating surfaces.

In accordance with a concomitant feature of the invention, the means for supplying combustion air are connected to the compressor.

Other features which are considered as characteristic for the invention are set forth in the appended claims.

Although the invention is illustrated and described herein as embodied in a steam power plant and steam generator, especially suited for a steam power plant of this type, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
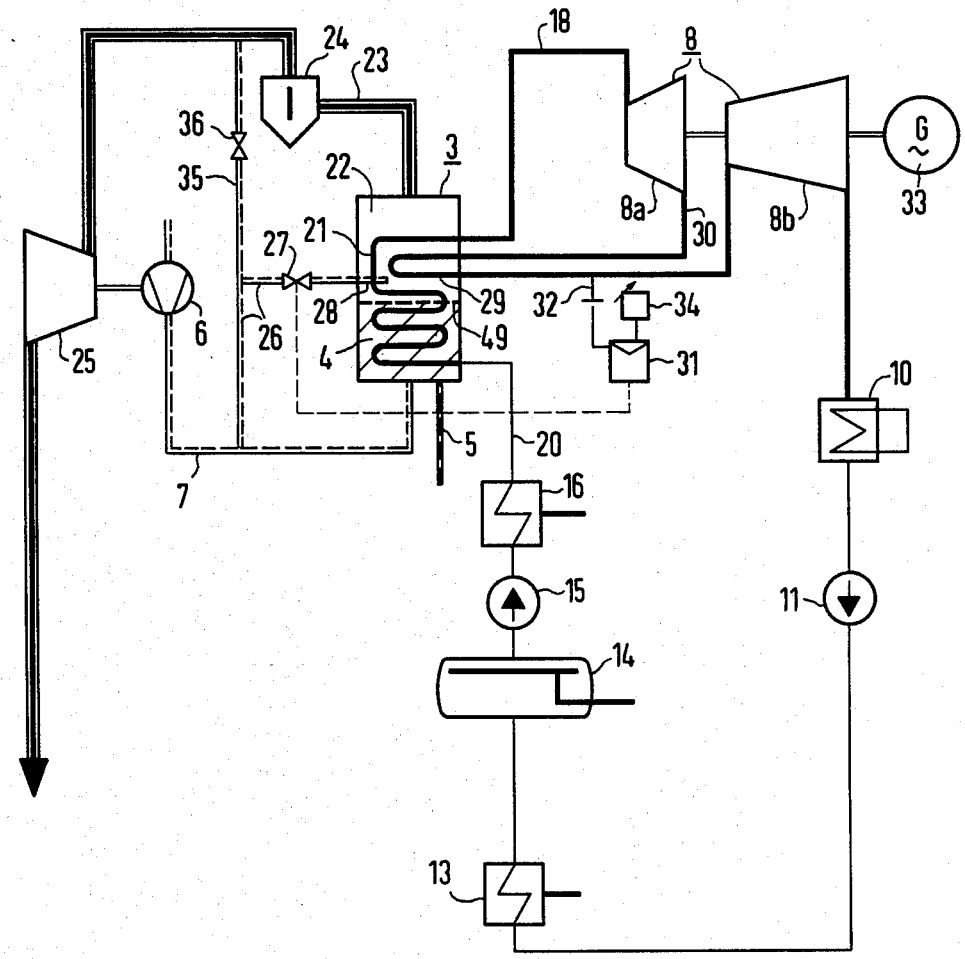
FIG. 1 is a schematic circuit diagram of a steam power plant.

Referring now to the figures of the drawing and first particularly to FIG. 1 thereof, there is seen a steam power plant which includes a continuous flow steam generator 3 and a steam turbine 8 with a high-pressure section 8*a* and a low-pressure section 8*b*. The steam turbine 8 is connected to a live steam line 18 which comes from the steam generator 3, and the steam turbine is coupled with an electric generator 33 and drives the generator. The continuous flow steam generator 3 is a so-called charged or chargeable steam generator, having a combustion chamber 4 shown with dotted lines, in which a fluidized bed or layer of powdered coal is burned along with an absorber such as calcite or dolomite contained therein. The powdered coal is conducted into the combustion chamber 4 by the diagrammatically illustrated supply line 5.

The steam generator 3 is charged with combustion air from a compressor 6 for the combustion air. The compressor 6 is connected to a combustion air supply line 7, which terminates in the combustion chamber 4 of the steam generator 3.

A condenser 10 for the expanded steam with a condensate pump 11, is disposed downstream of the low-pressure section 8*b* of the steam turbine 8. The pump 11 forces the condensate through a low-pressure preheater stage 13 into a feedwater tank 14, which also serves as a degaser. A feedwater pump 15 is attached to the feedwater tank 14, and a high-pressure feedwater preheater 16 is connected downstream of the feedwater pump 15. The feedwater preheater 16 is disposed in a feedwater supply line 20 leading to high-pressure heating surfaces 21 in the steam generator 3.

The high-pressure heating surfaces 21 in the steam generator 3 are essentially components in the form of economizer heating surfaces, evaporator heating surfaces and preheating and final superheating surfaces with a live steam outlet. The components are connected in series at the water side, and terminate into the live steam line 18.

The evaporator heating surfaces, preheating superheater surfaces and final heating superheater surfaces 21 are located in the combustion chamber 4 of the steam generator 3, where they are immersed in the fluidized bed of powdered coal.

A waste gas discharge line 23 with a dust separator 24 is connected to a convection space 22 which is located above the combustion chamber 4, and which communicates with the combustion chamber 4 above the border or barrier indicated by the dotted lines 49. A waste or exhaust gas turbine 25 is disposed downstream of the dust separator 24. The exhaust gas turbine 25 is advantageously used as the drive for the air compressor 6, to which it is coupled. Connected to the combustion air admission or supply line 7 coming from the compressor 6, is an additional air line 26, which contains an air valve 27 serving as a regulating element. A nozzle 28 for cooling gas is connected to the additional air line 26 downstream of the valve 27, and the nozzle 28 terminates in the convection space 22 of the steam generator 3 between the combustion chamber 4 and an intermediate superheater heating surface 29 which is disposed in the convection space 22. The intermediate superheater heating surface 29 is separated at the water side from the high-pressure heating surfaces 21 in the steam generator 3. Furthermore, this intermediate superheater heating surface 29 is attached with an intermediate superheater inlet thereof at an exhaust steam discharge port 30 of the high-pressure section 8*a* of the steam turbine 8, and the output port of the intermediate superheater heating surface 29 is attached to the low-pressure section 8*b* of the steam turbine 8.

The air valve 27 which serves as the regulating element is connected to a regulator 31, which is in turn also connected to a sensor 32 for the actual steam temperature at the intermediate superheater discharge port, and a signal originator 34 giving the nominal temperature value of this steam.

If the actual temperature of the steam at the intermediate superheater discharge port deviates from the nominal temperature, the regulator 31 transmits commands for the air valve 27. The regulator transmits a "close" command to a non-illustrated setting motor for the air valve 27 if the actual temperature is less than the nominal temperature, and the regulator transmits an "open" command if the actual temperature is higher than the nominal temperature.

Air which has been moved into the combustion air line 7 by the compressor 6, but which is not required as combustion air in the combustion chamber 4 or as cooling air in the convection space 22 of the steam generator 3, can be blown through a bypass line 35 containing an air control valve 36, and into the exhaust gas line 23 between the dust separator 24 and the exhaust gas turbine 25.

Figure 2:
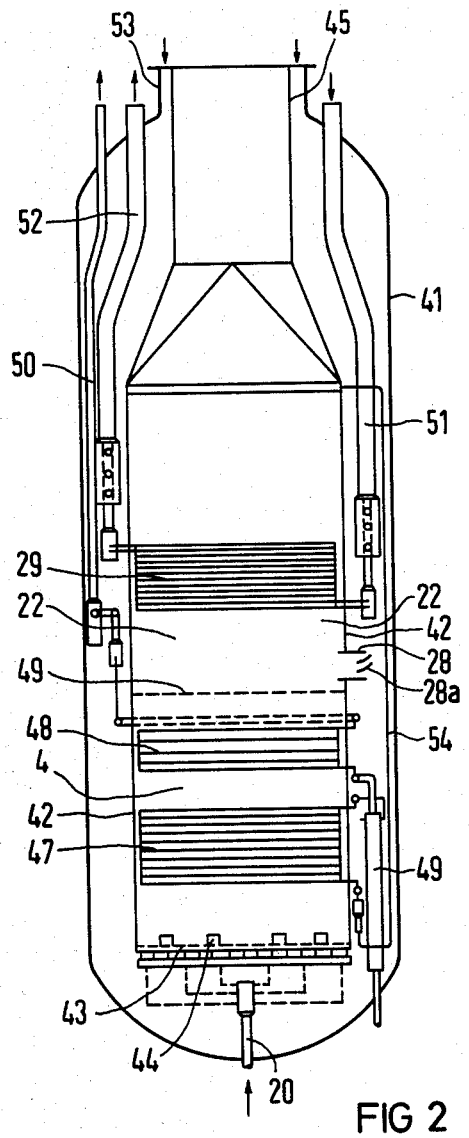
FIG. 2 is a diagrammatic longitudinal sectional view of a steam generator for a steam power plant according to FIG. 1.

FIG. 2 shows a steam generator which can be used in a steam power plant according to FIG. 1. This steam generator has a closed, hollow, cylindrical steel housing 41, which is erected with a vertical longitudinal axis. In this steel housing is a coaxial duct with a square cross section and side walls 42 which act as an economizer. The side walls 42 are formed by circularly rising finned tubes which are welded to each other. This coaxial duct is closed at the bottom by a bottom part 43, which is also formed by finned tubes that are joined by welding. Disposed in the bottom part 43 are combustion air jets 44 which terminate in the duct. At the bottom end, opposite the open end space of the duct, a coaxial tube 45 which serves as an exhaust gas discharge tube, is welded to the side walls 42, and extends throughout the length of the steel housing 41.

The feedwater supply line 20 is conducted through the bottom of the steel housing 41, and is attached to the tubes of the bottom part 43. The tubes of the bottom part 43 are in turn connected to the tubes of the side walls 42 that are disposed downstream of the bottom part tubes. Above the bottom part 43, an evaporator heating surface 47 with a final superheater heating surface 48 connected in series thereto, is located in the duct formed by the side walls 42 inside the combustion chamber 4 of the steam generator. The intermediate superheater heating surface 29 is located in the duct formed by the side wall 42 inside of the convection space 22. A connecting pipe 54 is disposed in the interspace between the sidewalls 42 and the inside of the steel housing 41. The input of the evaporator heating surface 47 is connected by the pipe 54 to a header or collector at the outlet of the sidewalls 42, which serve as an economizer. The border between the combustion chamber 4 and the convection space 22 in the duct formed by the sidewalls 42 is indicated by the dotted line 49. Between this border zone, i.e. between the combustion chamber 4 and the intermediate superheater heating surface 29, the nozzle 28 for cooling air is disposed in one of the side walls 42 of the duct. The nozzle 28 ends on one hand in the convection space 22 and on the other hand in the interspace between the side walls 42 and the inside of the steel housing 41. The nozzle 28 is provided at its inlet cross section with adjustable flaps 28*a* which also serve as guide baffles.

A water separator 49′ is disposed in the interspace between the sidewalls 42 and the inside of the steel housing 41. The outlet of the evaporator heating surface 47 is attached through the water separator 49′ to the inlet of the final superheater heating surface 48. The live steam outlet of the final superheater heating surface 48 is formed by a live steam pipe 50 which is also located in the interspace between the sidewalls 42 and the inside of the steel housing 41, and which is conducted to the outside through the steel housing 41.

A separate supply line 51 and discharge pipe 52 are provided for the inlet and outlet of the intermediate superheater heating surface 29. The line 51 and pipe 52 are also positioned in the interspace between the sidewalls 42 and the inside of the steel housing 41, and are conducted through the steel housing.

The cover of the steel housing 41 is provided with a short air inlet or pipe 53. Coaxially disposed in the inlet 53 is the pipe 45 which serves as an outlet for the crude gas, and has a smaller cross section than the air inlet 53. In this way air can be admitted from the outside into the interspace between the sidewalls 42 and the steel housing 41 between the pipe 45 and the air inlet 53. From this interspace, the air can enter on one hand into the combustion chamber through the combustion air nozzles 44 in the bottom part 43 of the duct, and on the other hand the air can enter through the nozzle 28 for the cooling gas into the convection space 22 between the combustion chamber 4 and the intermediate superheater heating surface 29.

The foregoing is a description corresponding to German Application No. P 31 32 659.5, dated Aug. 18, 1981, the International priority of which is being claimed for the instant application and which is hereby made part of this application. Any discrepancies between the foregoing specification and the aforementioned corresponding German application are to be resolved in favor of the latter.

We claim:

1. Steam power plant, comprising:

a steam turbine having a high-pressure part and a low-pressure part;

a chargeable steam generator including a convection chamber, a waste gas discharge line, a single fluidized bed combustion chamber, a high-pressure heater, and an intermediate superheater having an inlet connected to said high-pressure part of said steam turbine, an outlet connected to said low-pressure part of said steam turbine, and a heating surface, said intermediate superheater being disposed in said convection chamber for influencing steam temperature at said outlet of said intermediate superheater;

a gas turbine connected in said waste gas discharge line downstream of said steam generator;

an air compressor connected to and driven by said gas turbine;

a combustion air supply line connected from said air compressor to said combustion chamber, said air supply line having a nozzle discharging into said convection chamber between said combustion chamber and said heating surface of said intermediate superheater, and said air supply line having an air valve for controlling air fed to said nozzle;

a regulator operatively connected to said air valve for controlling said air valve, a sensor being operatively connected to said regulator and disposed in vicinity of said outlet of said intermediate superheater for sensing the actual temperature of steam leaving said outlet, and a signal transmitter operatively connected to said regulator for giving said regulator a nominal value for the temperature of steam leaving said outlet, said regulator controlling said air valve causing the actual temperature to approach the nominal temperature at said outlet;

and a bypass line connected from said air supply line to said waste gas discharge line, said bypass line having another air control valve connected therein.

* * * * *